US010006611B2

(12) United States Patent
DeOliveira

(10) Patent No.: US 10,006,611 B2
(45) Date of Patent: Jun. 26, 2018

(54) HYBRID LIGHT FIXTURE HOUSING

(71) Applicant: Hubbell Incorporated, Shelton, CT (US)

(72) Inventor: Avelino DeOliveira, Inman, SC (US)

(73) Assignee: Hubbell Incorporated, Shelton, CT (US)

( * ) Notice: Subject to any disclaimer, the term of this patent is extended or adjusted under 35 U.S.C. 154(b) by 147 days.

(21) Appl. No.: 14/169,330

(22) Filed: Jan. 31, 2014

(65) Prior Publication Data

US 2014/0240965 A1 Aug. 28, 2014

Related U.S. Application Data

(60) Provisional application No. 61/759,348, filed on Jan. 31, 2013.

(51) Int. Cl.

| | |
|---|---|
| ***F21V 15/01*** | (2006.01) |
| *B21D 22/26* | (2006.01) |
| *F21S 8/02* | (2006.01) |

(52) U.S. Cl.

CPC ..... *F21V 15/01* (2013.01); *B21D 22/26* (2013.01); *F21S 8/026* (2013.01); *Y10T 29/49826* (2015.01); *Y10T 29/49956* (2015.01)

(58) Field of Classification Search

CPC ..... F21S 8/026; F21S 8/03; F21S 8/04; F21S 8/043; F21V 15/01; F21V 15/012; F21V 15/013; F21V 17/16; Y10T 29/4987; Y10T 29/49876; Y10T 29/49956; B21D 22/201; B21D 22/26

USPC ..... 362/362, 365, 368, 370, 364, 147, 148, 362/150; 72/347, 349

See application file for complete search history.

(56) References Cited

U.S. PATENT DOCUMENTS

| | | | | | |
|---|---|---|---|---|---|
| 532,355 | A * | 1/1895 | Bellinger | B21D 22/28 | 220/DIG. 22 |
| 2,533,661 | A * | 12/1950 | Arenberg | F21S 4/20 | 220/841 |
| 4,138,716 | A * | 2/1979 | Muhlethaler | F21S 8/06 | 362/260 |
| 4,980,808 | A * | 12/1990 | Lilos | F21V 21/00 | 362/219 |
| 5,309,342 | A * | 5/1994 | Heinen, Sr. | F21S 8/02 | 362/147 |
| 5,609,414 | A * | 3/1997 | Caluori | F21S 8/02 | 248/27.1 |
| 6,170,967 | B1 * | 1/2001 | Usher | F21V 23/06 | 200/227 |

(Continued)

FOREIGN PATENT DOCUMENTS

| | | | | |
|---|---|---|---|---|
| GB | 2169391 | A * | 7/1986 | F21V 29/30 |
| JP | 05217412 | A * | 8/1993 | |

*Primary Examiner* — Jermie Cozart

(74) *Attorney, Agent, or Firm* — Michael Best & Friedrich, LLP

(57) ABSTRACT

A hybrid light fixture housing comprising a roll formed or press fabricated metal housing substrate having ceiling interface side members formed from aluminum extrusion processes attached thereto. The ceiling interface side members may comprise a single extruded clip member configured to clip around the ends of the sidewalls of the housing substrate or a first backing bar piece secured to the housing substrate and a second ceiling trim member secured to the housing substrate and the backing bar.

10 Claims, 16 Drawing Sheets

(56) References Cited

U.S. PATENT DOCUMENTS 6,364,510 B1 * 4/2002 Bernhart ..... F21S 8/02 362/147
6,827,472 B1 * 12/2004 Myburgh ..... B60H 1/00371 362/125
7,618,167 B2 * 11/2009 Bedard ..... F21V 21/043 362/364
7,909,487 B1 * 3/2011 Venetucci ..... F21S 8/02 362/147
7,988,342 B2 * 8/2011 Pahl ..... F21V 21/112 24/457
8,333,490 B2 * 12/2012 Wu ..... F21S 8/02 362/147
8,454,192 B2 * 6/2013 Rouse ..... F21S 8/031 362/170
8,740,412 B2 * 6/2014 Rempel ..... F21S 8/026 362/254
8,950,908 B2 * 2/2015 Berman ..... F21S 8/02 220/3.7
9,033,537 B2 * 5/2015 Jang ..... F21V 17/12 362/147
9,134,015 B2 * 9/2015 Guercio ..... F21V 31/005
2004/0228135 A1 * 11/2004 Myburgh ..... B60H 1/00371 362/480
2006/0283130 A1 * 12/2006 Andrews ..... E04B 2/767 52/633
2009/0225282 A1 * 9/2009 Matsumiya ..... G03B 21/2093 353/85
2011/0110095 A1 * 5/2011 Li ..... F21V 29/004 362/294
2011/0134651 A1 * 6/2011 Berman ..... F21S 8/02 362/365
2012/0230030 A1 * 9/2012 Miller ..... F21S 2/005 362/249.01
2012/0325982 A1 * 12/2012 Guercio ..... F21V 31/005 248/65
2013/0021784 A1 * 1/2013 Jang ..... F21V 17/12 362/147
2013/0271986 A1 * 10/2013 Rempel ..... F21S 8/026 362/249.02
2014/0240965 A1 * 8/2014 DeOliveira ..... F21V 15/01 362/147

* cited by examiner

HYBRID LIGHT FIXTURE HOUSING

CROSS-REFERENCE TO RELATED APPLICATIONS

This application claims the benefit of priority under 35 U.S.C. § 102 (e) to U.S. Provisional Application No. 61/759,348 filed Jan. 31, 2013, the entire contents of which are hereby incorporated by reference.

FIELD OF THE INVENTION

The present invention relates generally to light fixture housings. More particularly, the present invention relates to light fixture housings and methods of making light fixture housings by combining the manufacturing benefits of sheet metal housing fabrication with that of extruded aluminum housing fabrication to create a "hybrid" light fixture housing comprising a sheet metal housing composite base coupled with one or more predetermined aluminum extrusion profile members.

BACKGROUND OF THE INVENTION

Manufacturing methods for mass production of lighting fixtures are known in the art. Two common manufacturing methods used in the industry to produce the housings for light fixtures include the sheet metal ("roll formed" and/or "press fabricated") technique and "extruded aluminum" technique. When it comes to mass production of large volumes of a predetermined number of standard sizes and shapes of light fixtures, either of these methods are suitable and the decision as to which one to use is based on a number of financial and logistical factors understood by those in the art. However, when it comes to manufacturing various volumes of light fixtures that will be produced for a given order with various differing ceiling interfaces and fixtures widths, both of these standard methods have their drawbacks.

To put the typical dilemma in context, when a large order of recessed lights is placed for an area having a lot of different lights and ceiling interfaces, such as an airport, the problem of how to meet the requirements of a large number of ceiling interfaces for varying fixture widths is presented. For example, if the project involves fifteen different ceiling interfaces, then for an installation involving four different fixture widths and a single fixture length, sixty different housings are required (15×4×1=60). However, typical installations can involve five different lengths or more raising the permutations of required housings to at least 300 (60×5=300). Moreover, if "rows" of fixtures are required for different areas (2's, 3's, 4's), the number of housings could be pushed to 900 or more.

As will be appreciated, faced with large volumes of varying fixture housings, the two common manufacturing methods present technological and cost-prohibitive problems. For example, with sheet metal housings, even with an unlimited tooling budget, a roll former could not satisfy the number of housing variations required. Likewise, with press fabricated housings the ability to meet all of the required variations would not only be problematic but also conceivably result in countless, and prohibitive, numbers of parts to meet the required housing configurations. These problems essentially foreclose the ability to rely on sheet metal production methods to complete these types of custom projects in a cost efficient manner.

Similarly, with extruded aluminum housing profiles, a number of practical and logistical problems are presented. First, extruded aluminum is relatively expensive. The expense is exasperated given the size of the extrusion profiles which would be required to satisfy the variety of housings called for by the project. Inventory also presents a problem because the production volume for even a relatively large project would not be high enough to "beat down" the cost of the aluminum extrusion with large extrusion runs as it would be in typical mass production settings. In other words, to be able to satisfy all the needs, "raw lengths" of about sixty different aluminum extrusion profiles would need to be ready to satisfy production orders. Even if practicable in a given situation, additional secondary operations such as holes, slots, etc. would require costly machining operations (as compared to sheet metal operations). These drawbacks essentially foreclose the ability to use extruded aluminum methods to complete typical custom projects in a cost efficient manner.

The foregoing underscores some of the problems with conventional fixture housing construction methods, especially in batch job situations. Furthermore, the foregoing highlights the long-felt, yet unresolved need in the art for a construction method that can be commercially practicable in small scale productions with varying fixture configuration requirements. In addition, the foregoing highlights the inventor's recognition and need in the art for a construction method that overcomes the disadvantages and challenges of sheet metal fixture manufacturing methods and extruded aluminum fixture manufacturing techniques.

SUMMARY OF THE INVENTION

Various embodiments of the present invention overcome various of the aforementioned and other disadvantages associated with prior art light fixture housing fabrication methods, and in particular, non-mass production scenarios involving a multitude of housing requirements. The present invention is based, in part, on the discovery that a sheet metal housing substrate could be manufactured by conventional methods and then have affixed thereto any number of a plurality of differing aluminum extruded profiles for assembly into a "hybrid" light fixture housing, proving particularly useful in satisfying a need for a large number of predetermined configurations. The present invention is also based, in part, on the discovery that the novel methods and configurations disclosed herein result in a kit that is adaptable and able to allow for assembly even in cases where the substrate and/or profiles are out of specification. The present invention is also based, in part, on the realization by the present inventor that advantageous aspects of standard sheet metal manufacturing processes can be combined with the advantageous aspect of standard aluminum extrusion manufacturing processes to result in a "hybrid" housing that combines the strengths of the various manufacturing methods to provide a superior, cost-effective end product.

According to one aspect of various embodiments of the present invention there is provided a sheet metal housing substrate having attached thereto aluminum extrusion members to complete a light fixture housing of a predetermined configuration. In accordance with this aspect of the invention, various embodiments of the invention comprise a metal housing substrate having upwardly extending sidewalls and aluminum extrusion side members bent into a flexible u-shaped or like "clip" form for frictionally receiving and retaining within the interior channel a corresponding sidewall of said metal housing substrate. The side member and sidewall are preferably mechanically attached via a rivet or the like to safeguard against slippage in the friction fit.

According to another aspect of various embodiments of the present invention there is provided a sheet metal housing substrate and a plurality of aluminum extrusion members extruded in the "splayed open" position. As will be appreciated, when assembled to the sheet metal housing substrate sidewalls, the splayed portion of the extrusion would be bent on to a sheet metal housing sidewall and then preferably further secured with fasteners or the like.

According to yet another aspect of various preferred embodiments of the present invention there is provided a two-piece extrusion and housing assembly kit. According to this aspect of the invention, there would be an extrusion profile creating the ceiling trim and a second extrusion piece (referred to hereinafter as the "backing bar") which would engage the trim piece and the sheet metal housing by a suitable manner and then preferably further secured with fasteners or the like.

The "two-piece extrusion" method is a presently preferred method because it does not present potential "tongue ratio" problems that, as one of ordinary skill in the art should appreciate, may develop when facing certain geometric requirements with the extrusion profile raising the cost and reaching ratios (e.g., 4:1) which may be difficult to maintain during production. The "two piece extrusion" method is also presently preferred because it does not present the potential problems of attempting real-time bending (especially with long housings) that may affect quality, speed, or production that may be faced with the "splayed extrusion" method. Although preferred over these other methods, the present invention should be understood to encompass these and other methods of assembling hybrid housing in addition to the "two piece extrusion" method.

Furthermore, while the present invention will be described in connection with the long-felt, yet unresolved need in the art of light fixture manufacturing for a solution to the disadvantageous in the art with prior art methods for batch production, one of ordinary skill in the art armed with the present specification will readily appreciate that the inventive methods and concepts herein are adaptable to virtually any industry that involves or encounters similar practical, logistical, and cost prohibitive issues in metal housing production.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

DETAILED DESCRIPTION OF THE EXEMPLARY EMBODIMENTS

Figure 1B:
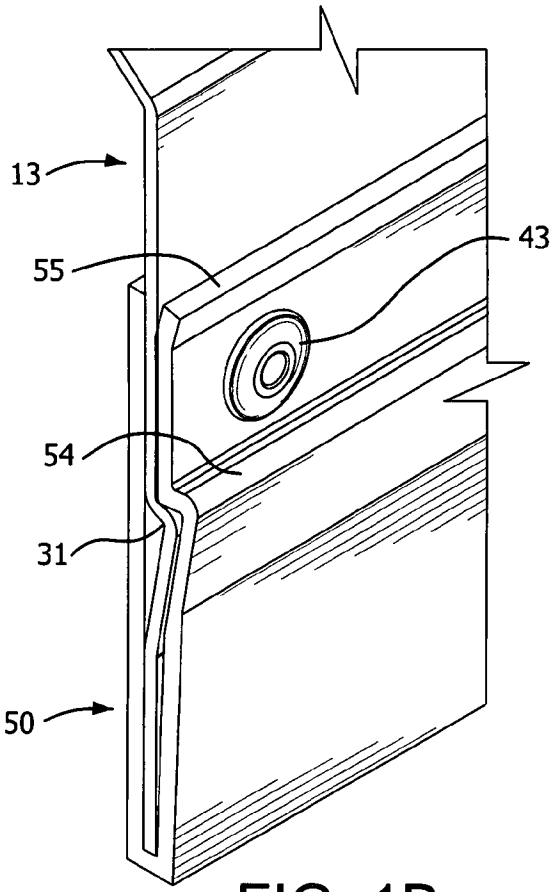
FIG. 1B is a right side perspective view of a connection point portion of a hybrid light fixture housing according to the invention.
Figure 1A:
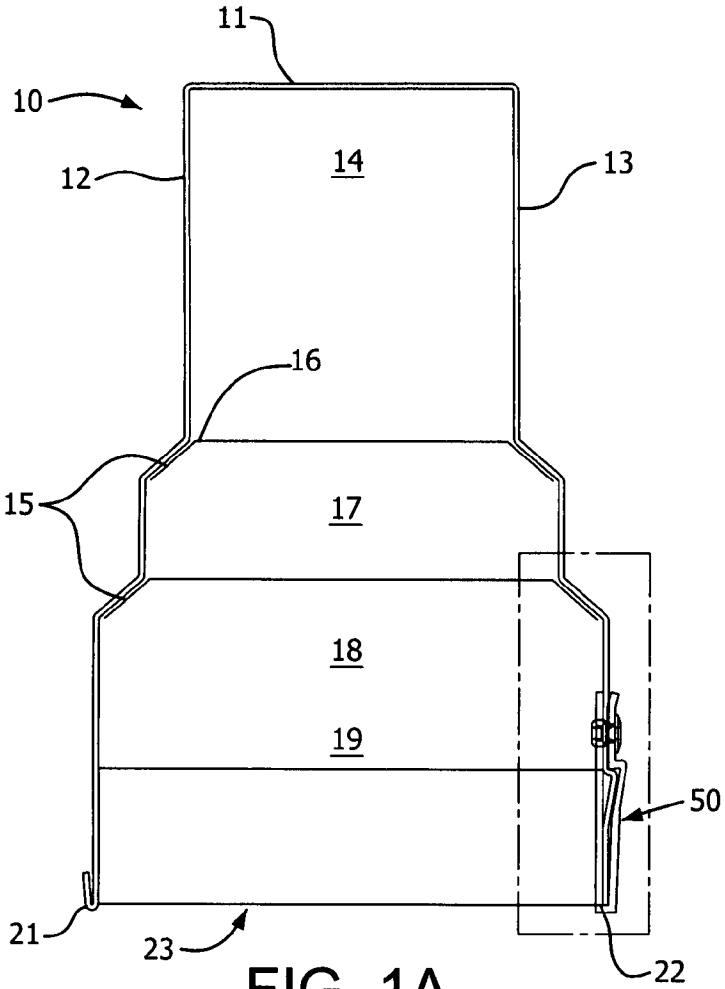
FIG. 1A is a front view of an embodiment of a hybrid light fixture housing according to the invention.

In exemplary embodiments of the present invention shown in FIGS. 1-16, there is depicted generally a hybrid light fixture 1 comprising a housing substrate 10 formed of sheet metal that is configured to have flat back 11 and bent sidewalls 12, 13 defining an interior chamber area 14. The sidewalls 12, 13 are generally telescoping outwardly by a series of bends 15 to define separate chambers that typically include (as depicted in FIG. 1) a small, square back ballast compartment 16, a slightly larger regressed reflector area 17, an even slightly larger non-regressed reflector area 18, a progressively larger regressed lens area 19, and/or a large non-regressed lens area 20 terminating at the ends 21, 22 of the sidewalls 12, 13 in a front 23 area of the fixture 1.

Figure 3B:
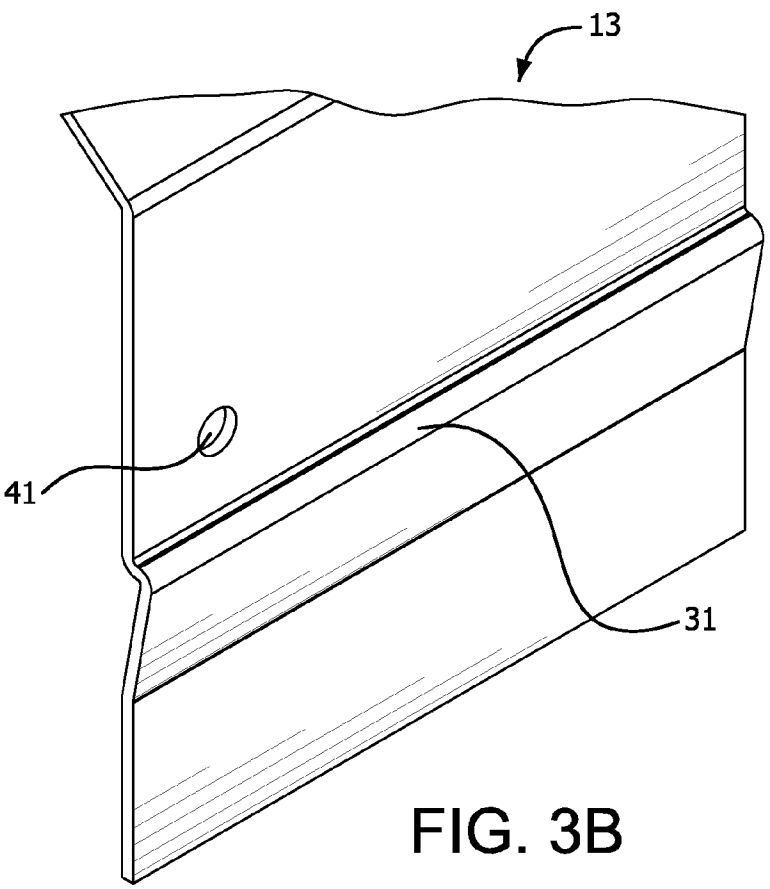
FIG. 3B is a right side perspective view of a portion of an end of a metal frame sidewall according to an embodiment of the invention.
Figure 3A:
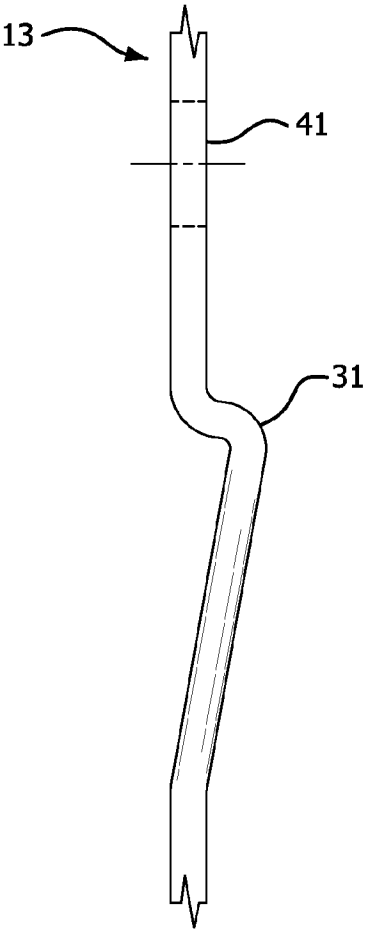
FIG. 3A is front view of a portion of an end of a metal frame sidewall according to an embodiment the invention.
Figure 4:
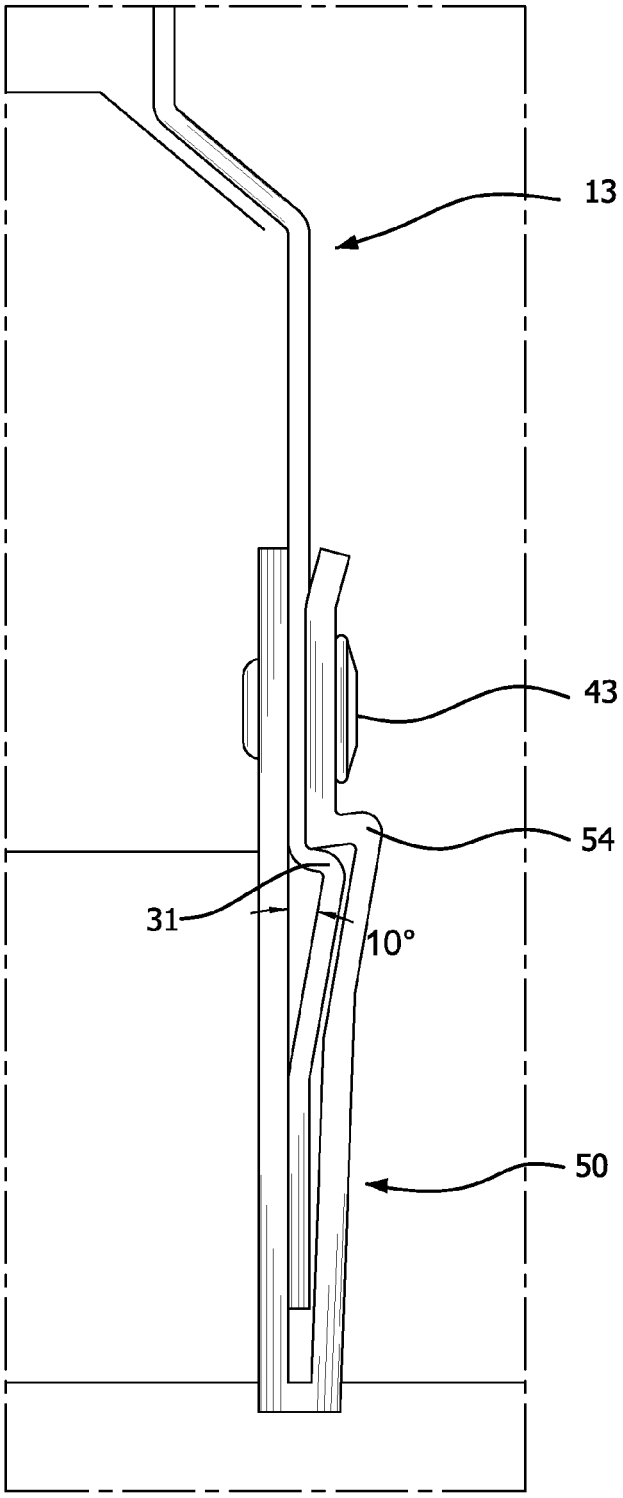
FIG. 4 is an enlarged front view of the connection point of the boxed area of the hybrid light fixture housing depicted in FIG. 1A.
Figure 5:
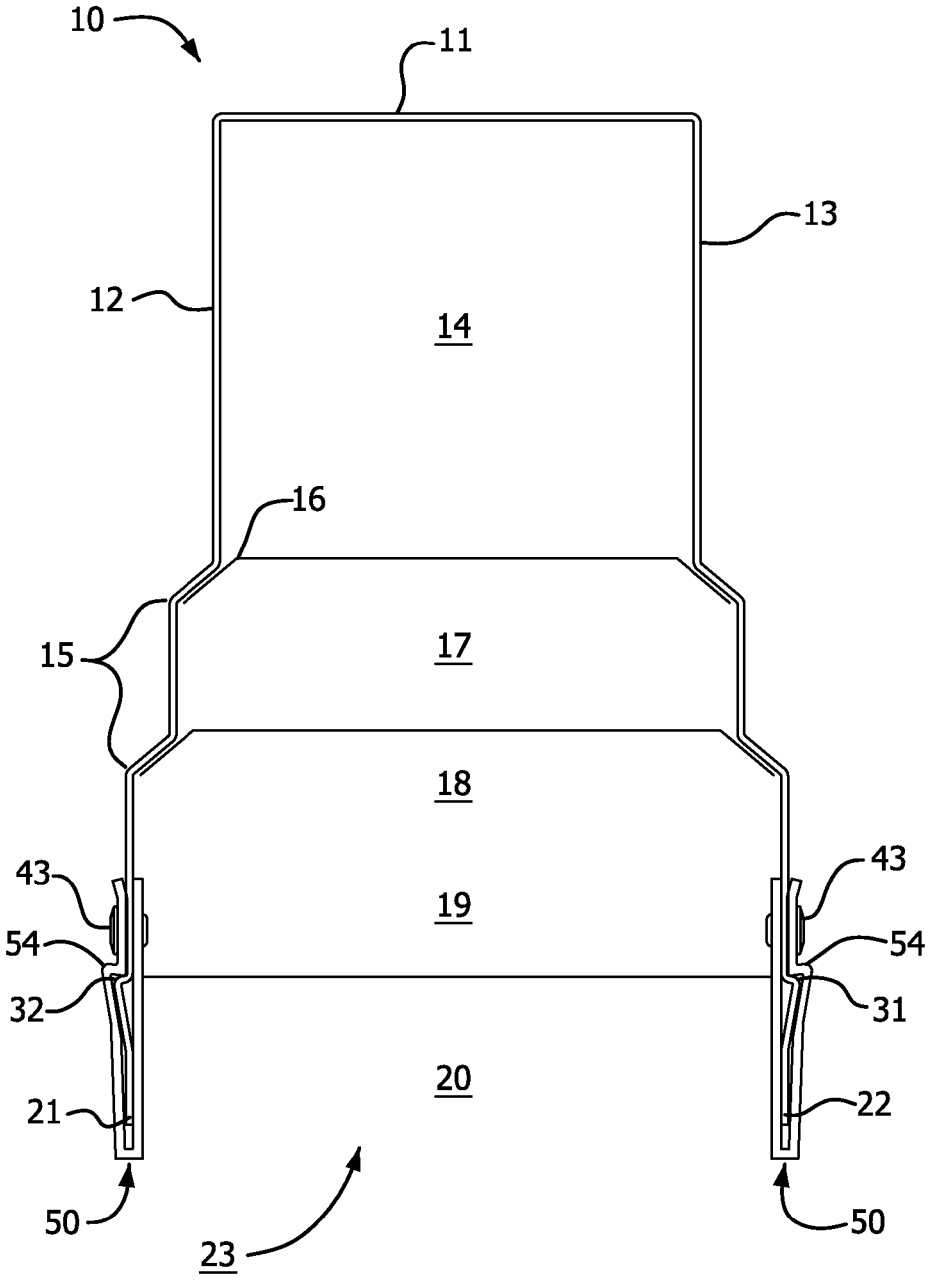
FIG. 5 is a front view of a hybrid light fixture housing according to an embodiment of the invention.
Figure 6:
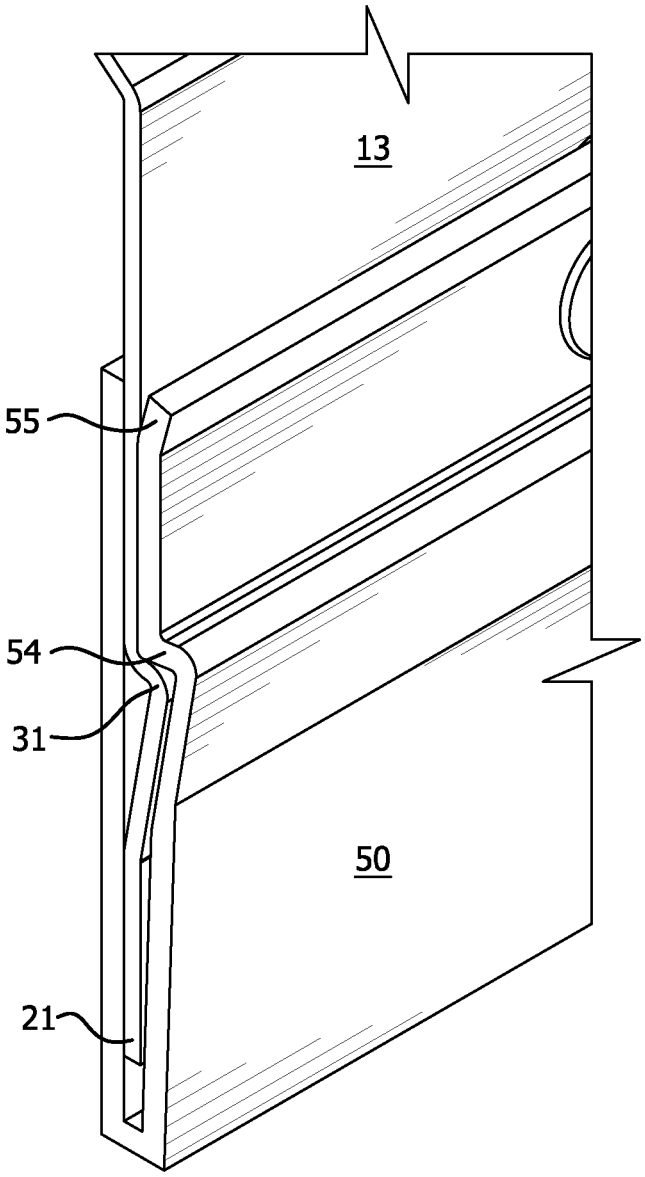
FIG. 6 is a right side perspective view of an connection point of portion of a hybrid light fixture housing according to another embodiment of the invention.
Figure 7:
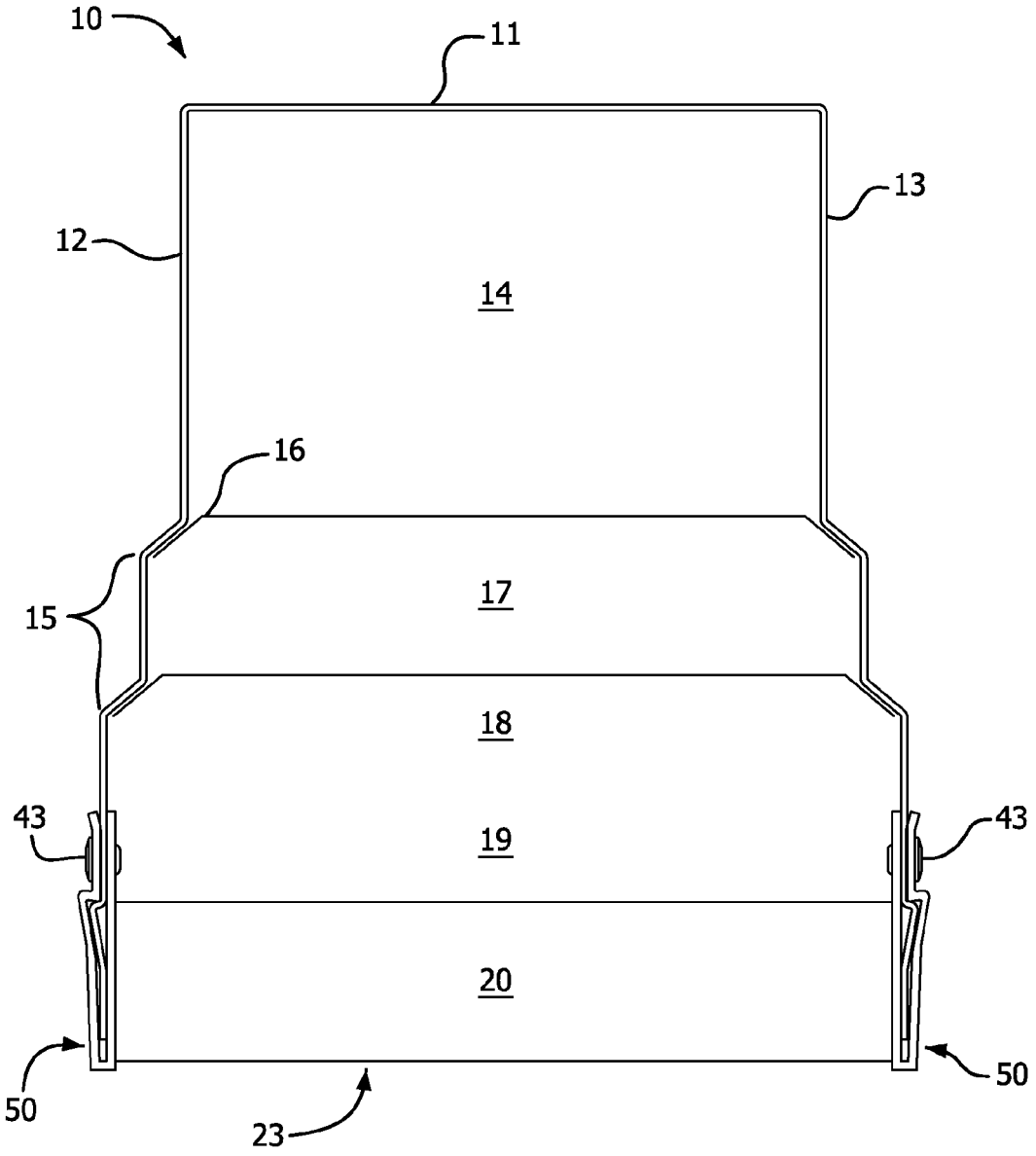
FIG. 7 is a front view of a hybrid light fixture housing according to another embodiment of the invention.
Figure 8:
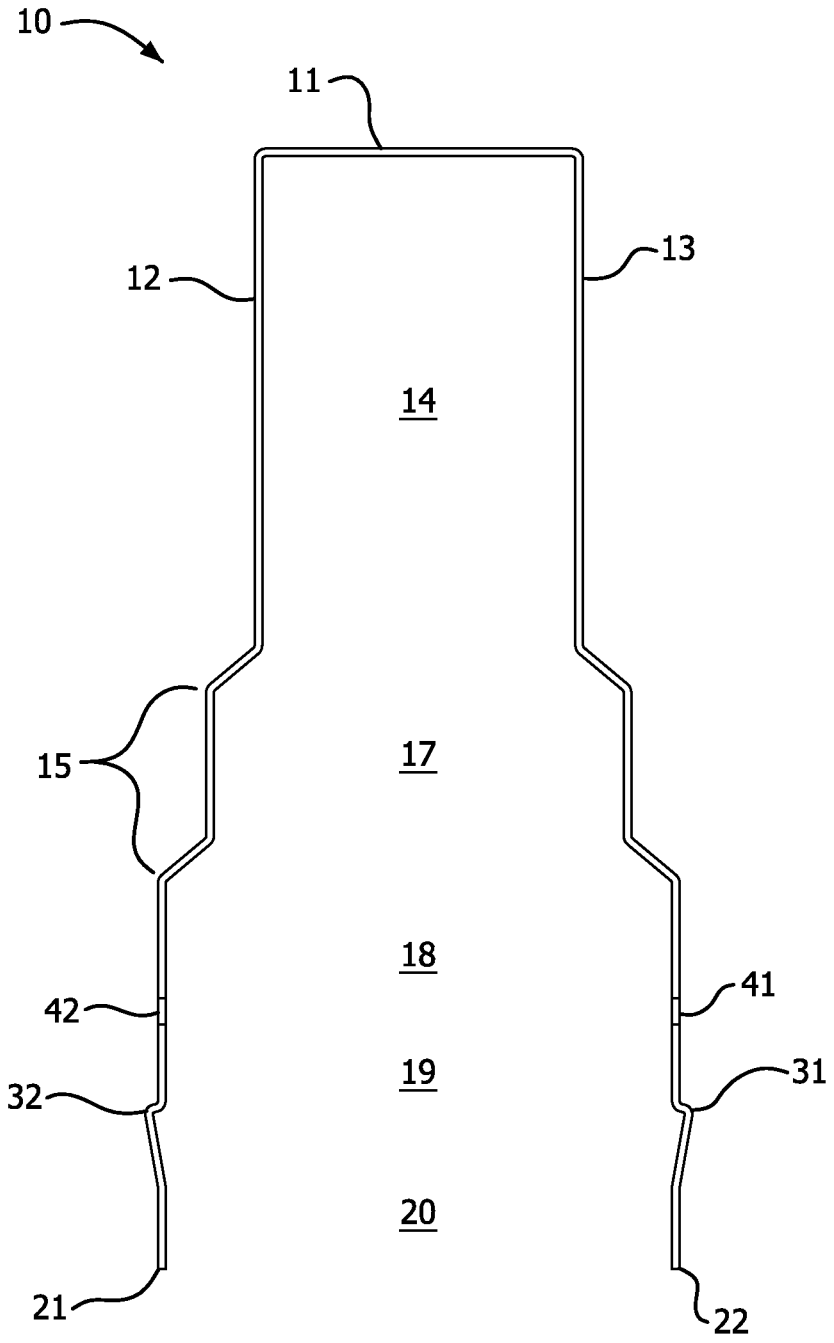
FIG. 8 is a front view of the metal frame sidewall of a hybrid light fixture housing according to an embodiment of the invention.
Figure 9:
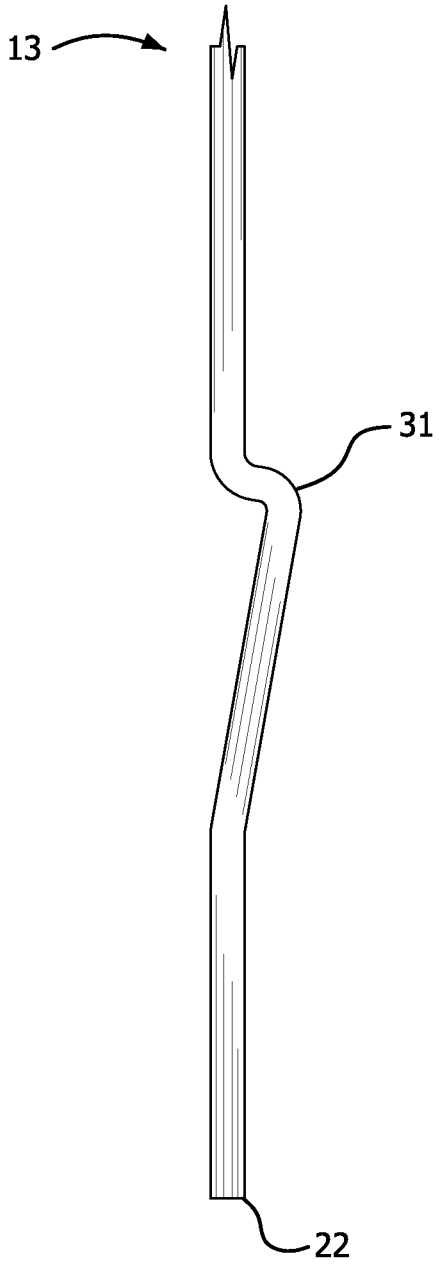
FIG. 9 is a front view of an end portion of a metal frame sidewall of a hybrid light fixture housing according to an embodiment of the invention.
Figure 10:
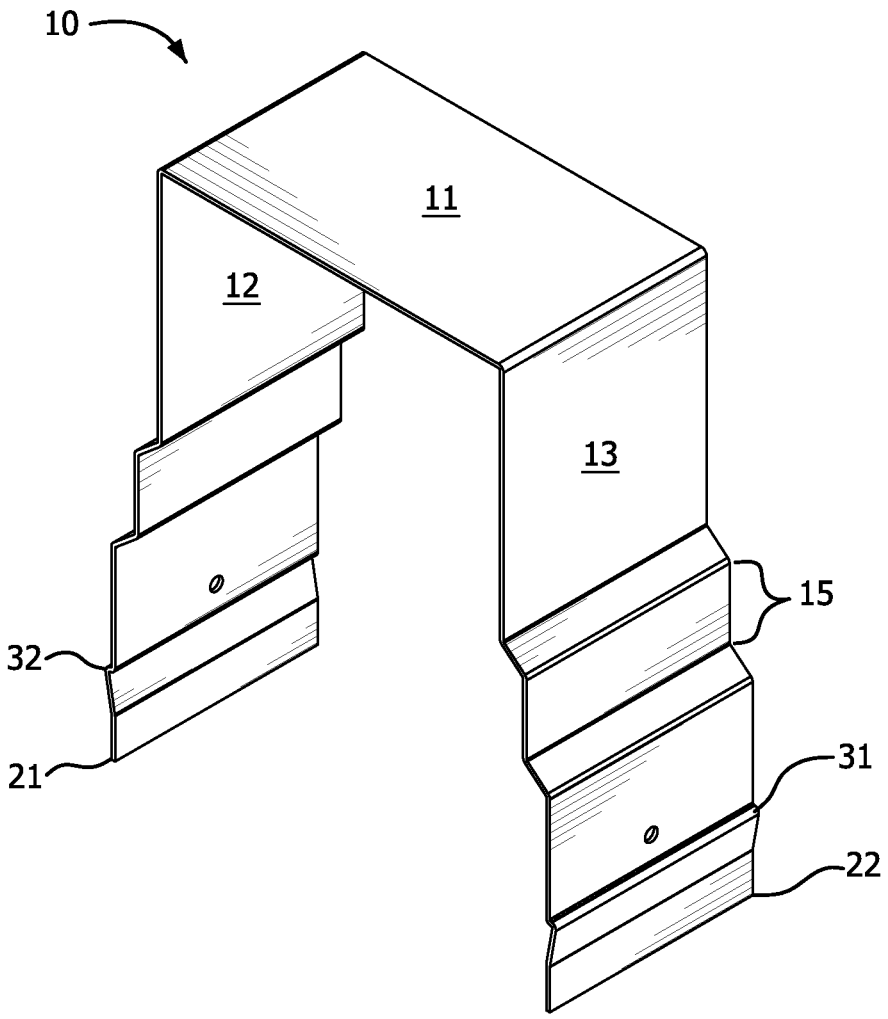
FIG. 10 is an elevated perspective view of a metal frame sidewall of a hybrid light fixture housing according to an embodiment of the invention.
Figure 11:
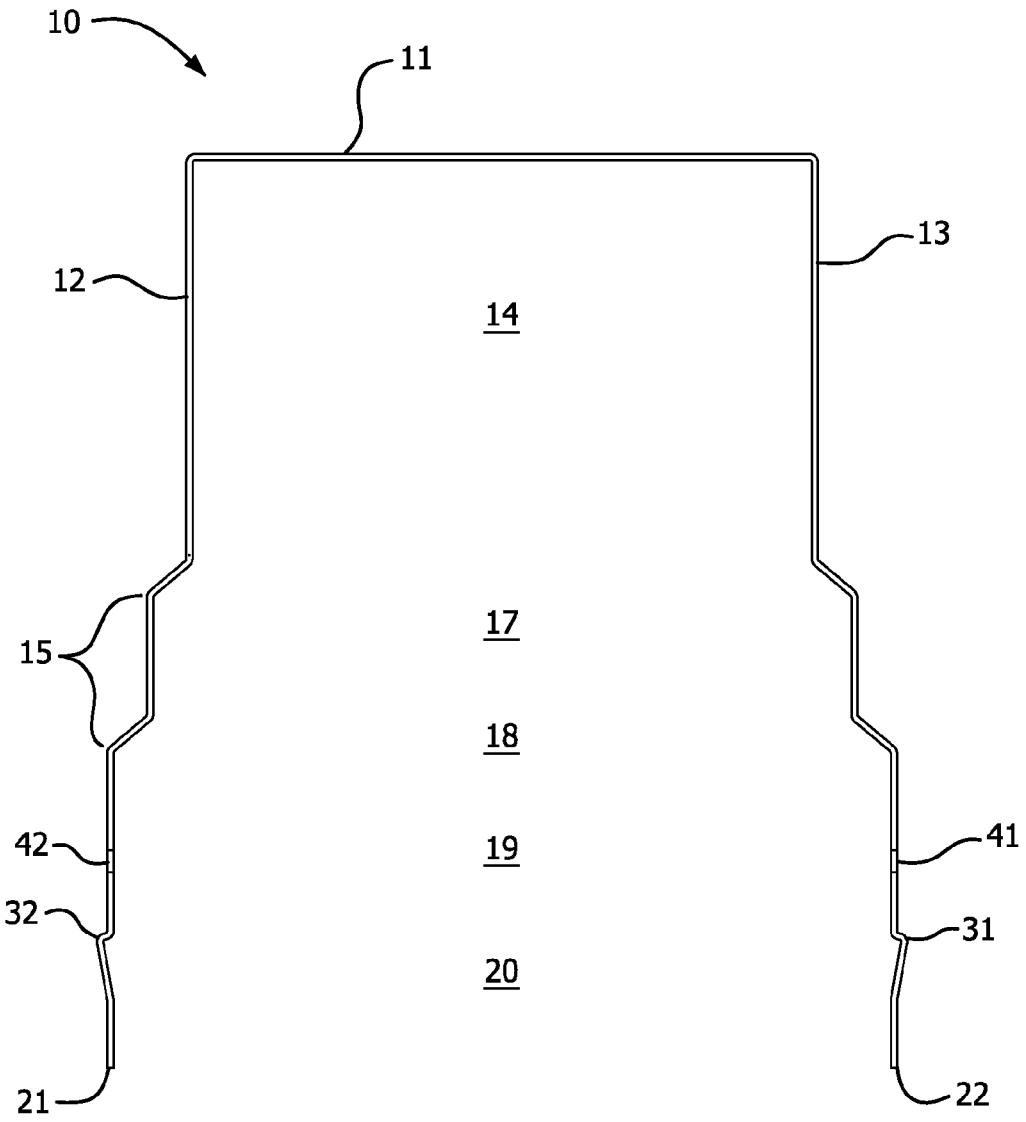
FIG. 11 is a cross section of the metal frame member of FIG. 10.

According to this embodiment of the invention, as best shown in FIG. 3, the ends 21, 22 of the sidewall 12, 13 of the housing include an outwardly deflected bend defining respective outer shoulders 32, 31. Above the outer shoulders 32, 31 of the ends 21, 22 of the sidewalls 12, 13 are rivet holes 41, 42. The shoulders 31, 32 and rivet holes 41, 42 allow for connection of extrusion members 50 to the housing 10, using rivet 43.

Figure 2:
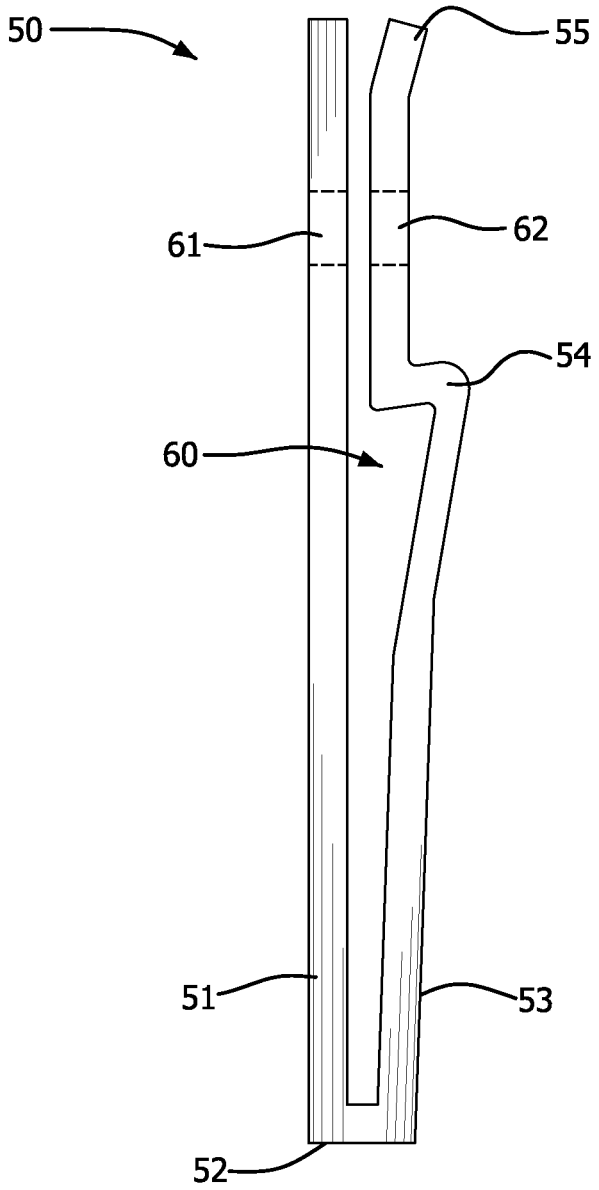
FIG. 2 is a front view of an embodiment of a u-shaped extrusion member according to the invention.

Extrusion members 50 are preferably extruded aluminum strips in lengths corresponding with the length of the housing sidewall to which it will be attached. The strips are bent to define generally u-shaped "clips" for clipping onto the ends of the sidewalls. As best shown in FIG. 2, each clip member 50 has a cross-section defining a channel 60. As depicted, the clip member 50 has a first straight side 51 descending to a u-bend 52 with the other side 53 ascending therefrom generally linearly but being bent to deflect outwardly and back to define a shoulder 54 positioned and sized to mate with a corresponding shoulder 31 of the housing sidewall end 21. The top of the second side 53 has a tapered end 55 to facilitate accepting the sidewall 21 of the housing into the interior channel 60 of the clip member 50. Both sides of the clip 50 are provided with corresponding rivet holes 41, 42 sized and positioned to allow a single rivet 43 to pass through the rivet holes 41, 42 of the clip 50 and housing sidewall to secure the sidewall in the channel 60 of the clip.

In operation, the clip 50 is forced fit onto the housing sidewall end 21. The elasticity and bias of the clip's u-shaped design allows it to be elastically deformed during fitting and resiliently clamp down on the sidewall when released. The shoulder of the clip pins the shoulder of the sidewall underneath to hinder slippage. To prevent slippage and ensure proper positioning of the substrate and extrusion member, one or more rivets are threaded between the corresponding rivet holes disposed along the length of the sides. After securing the extrusion members to each side of the housing substrate, the hybrid housing assembly is completed and ready for the next step in the fixture manufacturing and assembly process.

Figure 12B:
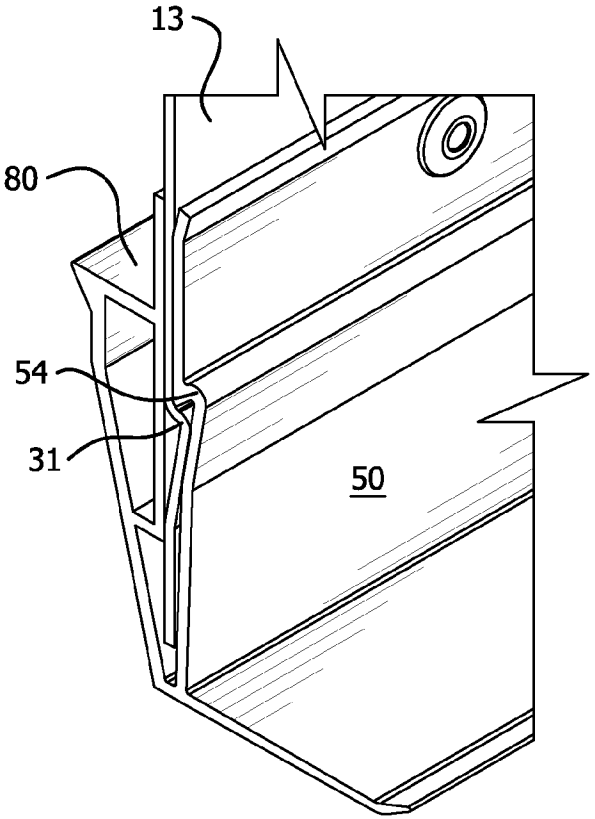
FIG. 12B is a right side perspective view of a connection point portion of an embodiment of a hybrid light fixture housing having extruded interior shoulders for regressed lenses according to the invention.
Figure 12A:
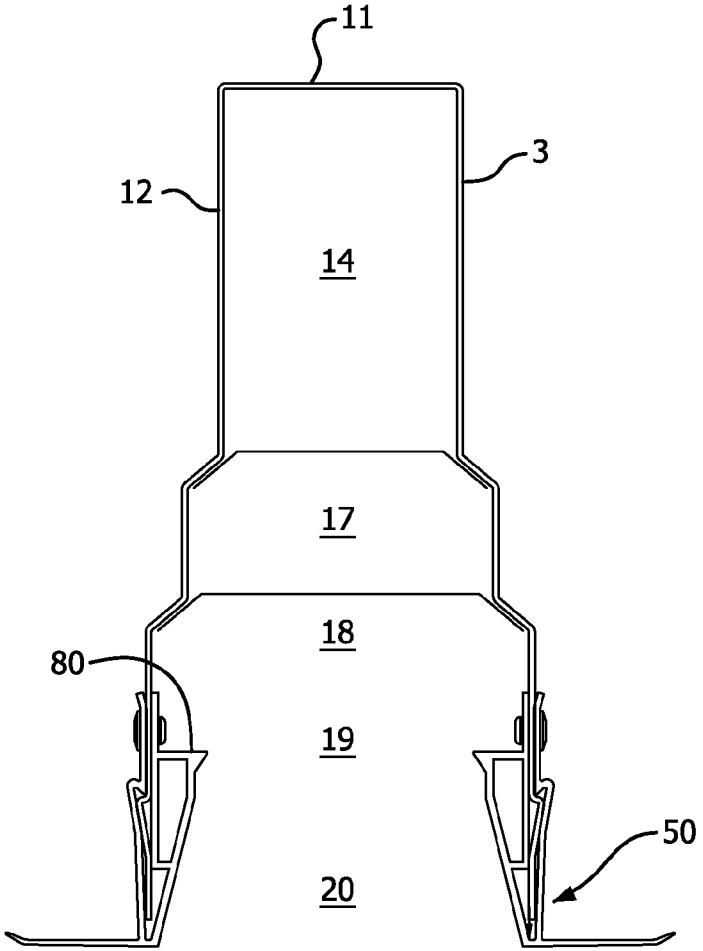
FIG. 12A is a front view of an embodiment of a hybrid light fixture housing having extruded interior shoulders for regressed lenses according to the invention.
Figure 13B:
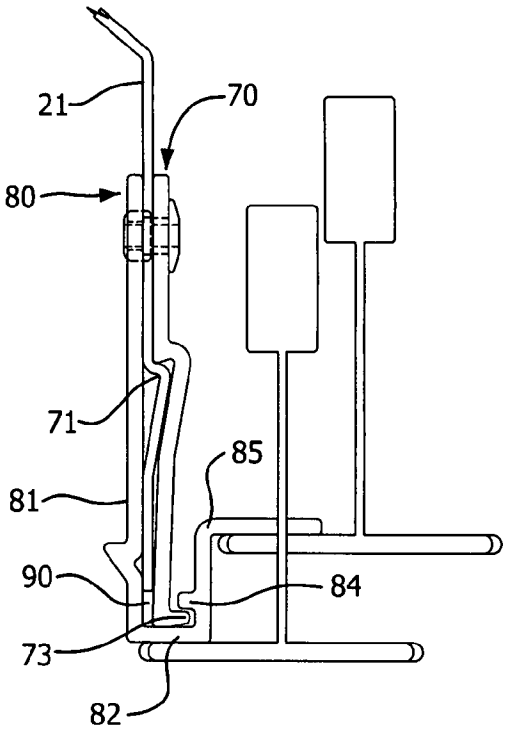
FIG. 13B is a front view of a connection point portion of an embodiment of a hybrid light fixture housing using the tow-piece extrusion method of the present invention.
Figure 13A:
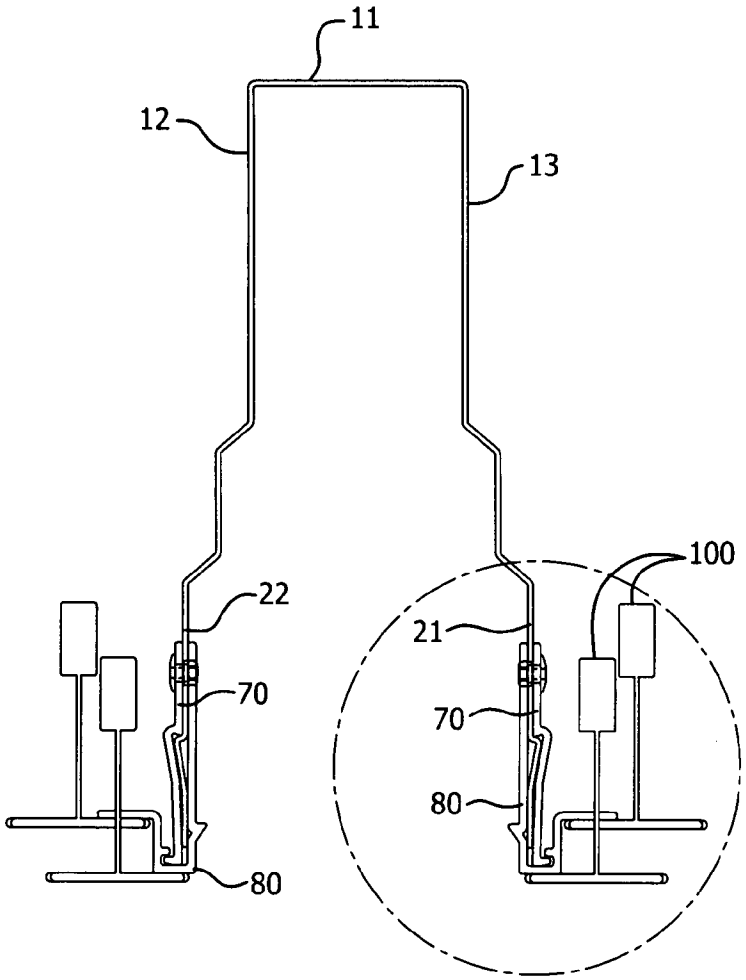
FIG. 13A is a front view of an embodiment of a hybrid light fixture housing using the tow-piece extrusion method of the present invention.
Figure 14:
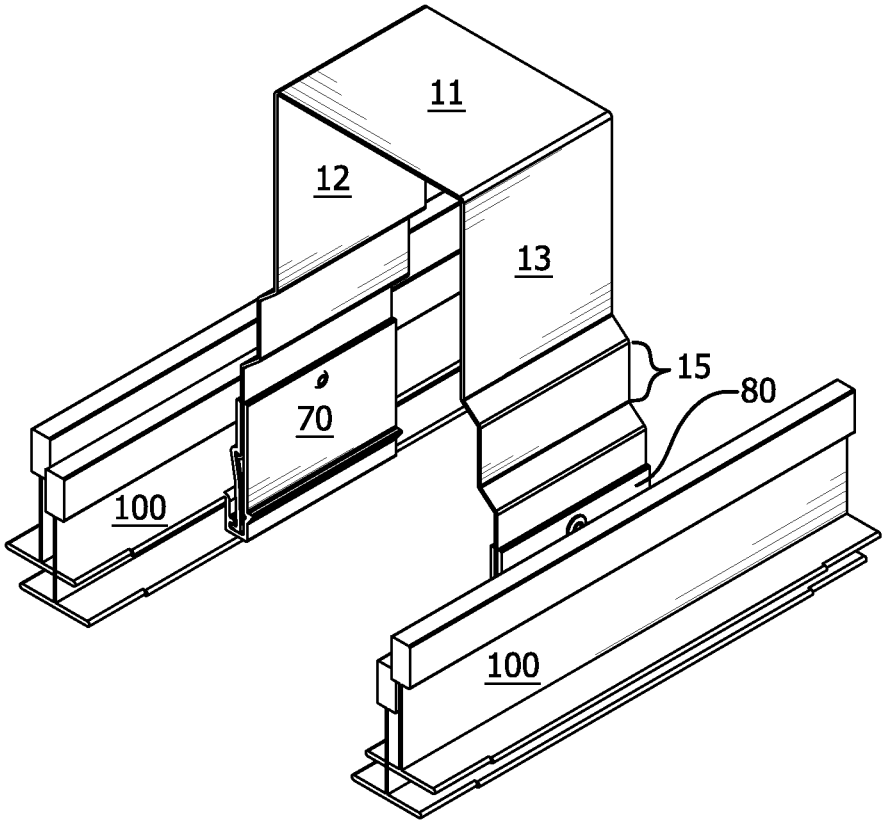
FIG. 14 is an elevated perspective view of a presently preferred embodiment of a hybrid light fixture housing using the two piece extrusion method according to the invention.
Figure 15:
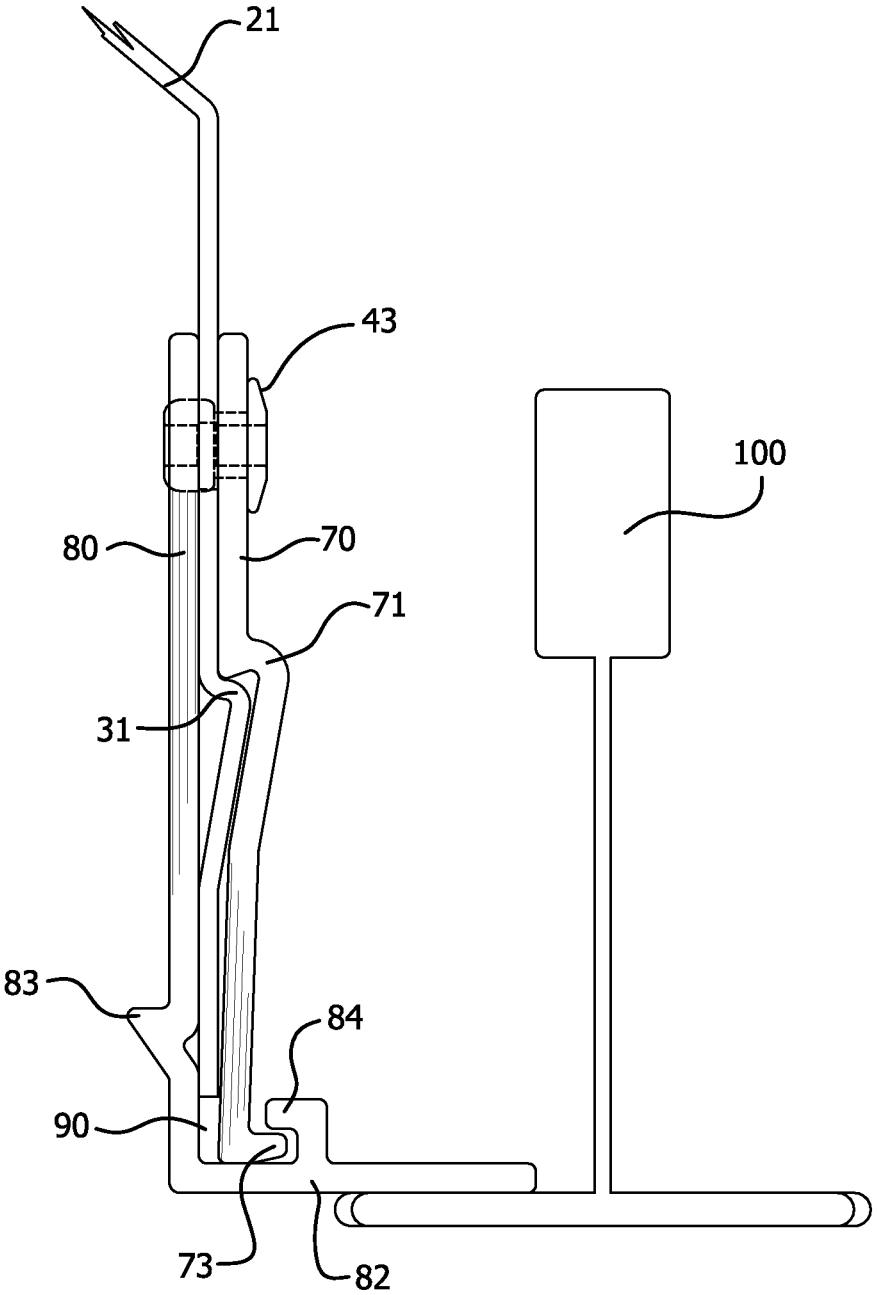
FIG. 15 is a front view of a connection point portion a presently preferred embodiment of a hybrid light fixture housing using the two piece extrusion method according to the invention.
Figure 16:
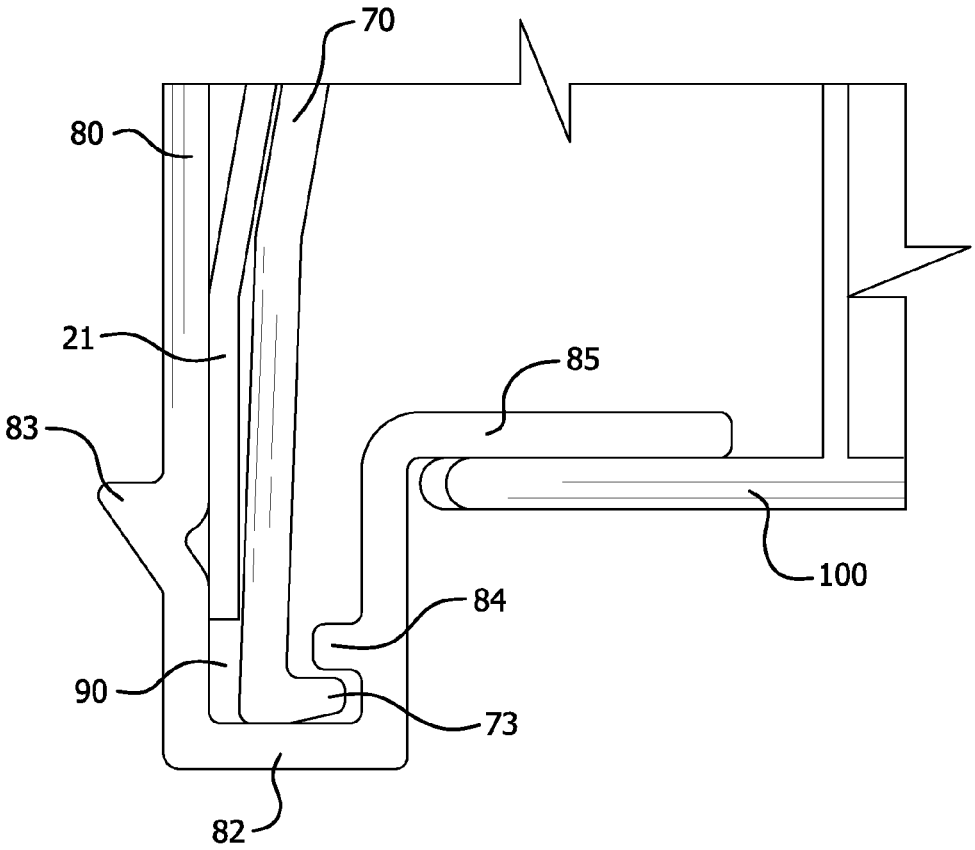
FIG. 16 is a front view of a portion of an embodiment of a hybrid light fixture housing using the two piece extrusion method for a grid ceiling.

FIGS. 1-11 show additional details and presently preferred details of the parameters of the housing substrate and extrusion members of the present invention for variously sized recessed lighting fixtures such as 2.5 inch, 3.5 inch, 4.0 inch, and 6.0 inch wide fixtures. FIG. 12 depicts a modified extrusion member wherein the extrusion member includes an interior shoulder or flange feature 80 that is particularly adapted for fixtures with recessed lenses.

FIGS. 13-16 depict a presently preferred embodiment of the invention demonstrating what is referred to as the "two piece extrusion" method. As depicted in the figures, the housing sidewall ends 21, 22 include shoulder bends 31, 32 similar to, but smaller than those of the one-piece extrusion embodiments of FIGS. 1-11. In addition, instead of having a single extruded member bent into a u-shaped clip member, the embodiment of FIGS. 13-17 includes an first outer "backing bar" 70 and a second, separate ceiling trim extrusion member 80.

As discerned from the various views, the backing bar 70 profile is similar to the outside of the u-clip of the previous embodiments. The top of the backing bar 70 includes a rivet hole 71 as seen in other embodiments. The backing bar 70 also includes a shoulder 71 formed from an outwardly deflecting bend relatively central to the bar 70. The shoulder 71 of the backing bar 70 also operates similarly to the previous embodiments in fitting over a matching shoulder ridge formed in the sidewall of the housing substrate (also resulting in the aligning of the corresponding rivet holes). A notable difference rests in that the backing bar 70 terminates to form a small flange or "foot" 73 at its distal end.

The ceiling trim extrusion member 80 is similar to the extrusion member of the previous embodiments with several notable exceptions. The ceiling trim extrusion member 80 has a first side 81 that descends generally linearly towards a u-shaped bend 82. However, the first side 81 includes a bend defining a small, outwardly projecting ledge 83. The member 80 follows the u-bend 82 with a small inwardly projecting flange 84 followed by an outwardly-extending L-shaped bend 85. The u-shaped bend 82 and flange 84 define a pocket 90 sized and shaped to accept the "foot" 73 of the backing bar 70. Preferably, as shown, the foot 73 is tapered and/or angled to allow it to cam past, and be retained under, the flange 84 and within the pocket 90. Once positioned, corresponding rivet holes in the backing bar, housing sidewall, and ceiling trim member allow the composite to be sandwiched and fastened together to prevent slippage and disengagement.

As shown in the figures, and as will be appreciated by one of ordinary skill in the art, the L-shaped bend 85 of ceiling trim member 80 and the u-shaped bend 82 serve as horizontal flanges or "stops" for the tracks of tee track assemblies 100. The u-shaped bend stop is used for "grid" ceiling interfaces (best shown on FIG. 15) and the L-shaped bend stop is used for "soft grid" ceiling interfaces (best shown on FIG. 16).

As will now be readily appreciated by one of ordinary skill in the art armed with the present specification, the inventive methods of the present invention lend themselves to forming metal housing substrates of desired widths and lengths that may be called into service to be recessed into any variety of ceiling types and arrangements. In brief, a plurality of aluminum extrusion members, e.g., ceiling trim members and backing bars, are extruded into predetermined lengths having profiles of the types described herein, or any other suitable configurations, that lend to sandwiching and mating with the housing substrate sidewalls in a manner that secures the housing composite together to form a hybrid fixture housing suitable for the area and conditions of deployment of the light fixture.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention.

I claim:

1. A housing for a light fixture assembly comprising:

a housing having a back, a first sidewall extending from the back, and a second sidewall extending from the back, at least one of the first and second sidewalls having an outwardly deflected bend defining a sidewall shoulder; and a clip connected to the housing and having a first side descending to a u-shaped bend and a second side ascending from the u-shaped bend, the second side including an outwardly deflecting bent portion defining a clip shoulder positioned and sized to mate with the sidewall shoulder, wherein the first and second sidewalls extend telescopically wider via a series of bends to define a first chamber, a second chamber larger than the first chamber, and a third chamber larger than the second chamber.

2. The housing of claim 1, wherein the housing is formed from sheet metal.

3. The housing of claim 1, further comprising a hole in an area above the sidewall shoulder for receiving a fastener.

4. The housing of claim 3, further comprising a rivet extending through the hole and connecting the housing and the clip.

5. The housing of claim 1, wherein the clip shoulder receives the sidewall shoulder via friction fit insertion that causes movement of at least one of the clip sides.

6. A housing for a light fixture assembly comprising:

a back wall;

a first sidewall extending from the back wall and having a first bend, a second bend, and a first end portion with a first outwardly deflected bend defining a first sidewall shoulder;

a second sidewall extending from the back wall and having a third bend aligned with the first bend, a fourth bend aligned with the second bend, and a second end portion with a second outwardly deflected bend defining a second sidewall shoulder, wherein the first sidewall and the second sidewall at least partially define a first chamber, a second chamber larger than the first chamber, and a third chamber larger than the second chamber; and a hole in an area above the first sidewall shoulder for receiving a fastener.

7. A housing for a light fixture assembly comprising:

a back wall;

a first sidewall extending from the back wall and having a first bend, a second bend, and a first end portion with a first outwardly deflected bend defining a first sidewall shoulder;

a second sidewall extending from the back wall and having a third bend aligned with the first bend, a fourth bend aligned with the second bend, and a second end portion with a second outwardly deflected bend defining a second sidewall shoulder, wherein the first sidewall and the second sidewall at least partially define a first chamber, a second chamber larger than the first chamber, and a third chamber larger than the second chamber; and a clip connected to the first end portion.

8. The housing of claim 7, wherein the clip includes a first side, a second side, and a u-shaped bend portion.

9. The housing of claim 8, wherein the second side includes an outwardly deflecting bent portion defining a clip shoulder positioned and sized to mate with the first sidewall shoulder.

10. The housing of claim 8, wherein the second side includes a tapered end formed by a portion of the second side angling away from the first side.

* * * * *